US006368258B1

(12) United States Patent
Emlaw

(10) Patent No.: US 6,368,258 B1
(45) Date of Patent: Apr. 9, 2002

(54) EXERCISE SYSTEM

(76) Inventor: Edward J. Emlaw, P.O. Box 48865, St. Petersburg, FL (US) 33743

( * ) Notice: Subject to any disclaimer, the term of this patent is extended or adjusted under 35 U.S.C. 154(b) by 0 days.

(21) Appl. No.: 09/562,166

(22) Filed: May 2, 2000

(51) Int. Cl.[7] ..... A63B 21/055
(52) U.S. Cl. ..... 482/124; 482/79; 482/125
(58) Field of Search ..... 482/124–126, 482/105, 907, 79

(56) References Cited

U.S. PATENT DOCUMENTS 904,339 A * 11/1908 Lievre ..... 482/125
2,498,006 A * 2/1950 Ridill ..... 482/125
4,728,103 A * 3/1988 Fulton ..... 482/125
4,930,767 A * 6/1990 Hamm ..... 482/124
4,993,705 A * 2/1991 Tolle ..... 482/124
5,277,680 A * 1/1994 Johnston ..... 482/95
5,411,461 A * 5/1995 Thomascik ..... 482/124
5,558,609 A * 9/1996 Olschansky et al. ..... 482/122
5,626,544 A * 5/1997 Foresto ..... 482/124
5,643,159 A * 7/1997 Iavarone ..... 482/125
5,713,142 A * 2/1998 Ahmed Fahmey El-Circy . 482/125
5,782,727 A * 7/1998 Pierce ..... 482/129
6,244,998 B1 * 6/2001 Hinds ..... 482/126

* cited by examiner

*Primary Examiner*—Mickey Yu
*Assistant Examiner*—Victor K. Hwang

(57) ABSTRACT

An exercising device includes a short strap having an interior surface and an exterior surface with a first end and a second end and an intermediate extent. A first pile-type fastener is provided on the interior surface and a second pile-type fastener on the interior surface. A large buckle has parallel end plates with parallel first and second end cross pieces and a central cross piece. The first end cross piece receives the first end. A long strap has a first end constituting a handle. An intermediate extent of the long strap is coupled to the exterior surface of the short strap.

2 Claims, 4 Drawing Sheets

72
74
76
84
80
82
78

EXERCISE SYSTEM

BACKGROUND OF THE INVENTION

1. Field of the Invention

The present invention relates to a solo-stretch exercise system and more particularly pertains to therapeutically stretching the feet, ankles, legs, hips and back of a user.

2. Description of the Prior Art

The use of exercising devices of known designs and configurations is known in the prior art. More specifically, exercising devices of known designs and configurations previously devised and utilized for the purpose of stretching and exercising through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,930,767 to Hamm discloses a therapeutic device. U.S. Pat. No. 5,004,228 to Powers discloses a leg stretching apparatus. Lastly, U.S. Pat. No. 5,656,002 to Dittmeier discloses a stretching rope with footbed.

While these devices fulfill their respective, particular objectives and requirements, the aforementioned patents do not describe a solo-stretch exercise system that allows therapeutic stretching the feet, ankles, legs, hips and back of a user.

In this respect, the solo-stretch exercise system according to the present invention substantially departs from the conventional concepts and designs of the prior art, and in doing so provides an apparatus primarily developed for the purpose of therapeutic stretching the feet, ankles, legs, hips and back of a user.

Therefore, it can be appreciated that there exists a continuing need for a new and improved solo-stretch exercise system which can be used for therapeutic stretching the feet, ankles, legs, hips and back of a user. In this regard, the present invention substantially fulfills this need.

SUMMARY OF THE INVENTION

In view of the foregoing disadvantages inherent in the known types of exercising devices of known designs and configurations now present in the prior art, the present invention provides an improved solo-stretch exercise system. As such, the general purpose of the present invention, which will be described subsequently in greater detail, is to provide a new and improved solo-stretch exercise system and method which has all the advantages of the prior art and none of the disadvantages.

To attain this, the present invention essentially comprises a short strap. The short strap has an interior surface and an exterior surface with a width of about 2 inches and a length of about 20.5 inches. The short strap has a first end with a stitched loop. The short strap also has a second end with a stitched fold. The short strap also has an intermediate extent between the ends. The short strap also has a first pile-type fastener on the interior surface between the first end and the intermediate extent. In addition, the short strap has a second pile-type fastener on the interior surface between the second end and the intermediate extent. The first and second pile-type fasteners are adapted to be releasably coupled together whereby the short strap may form a loop of a size determined by the user to receive a shoe on a user's foot. Next provided is a large buckle. The large buckle has parallel end plates. The end plates have parallel first and second end cross pieces. The end plates also have a central cross piece between the end cross pieces. The central cross piece is parallel with and intermediate of the end cross pieces. The first end cross piece receives the loop of the first end. The second end cross piece is cooperable with the central cross piece for receiving the second end between the second end cross piece and the central cross piece. A wide loop-shaped tab is next provided. The loop-shaped tab is stitched to the second end cross piece. Also provided is a narrow loop-shaped tab. The narrow loop-shaped tab is stitched to the second end. The tabs are adapted to facilitate the positioning of the short strap around a shoe of a user's foot and to facilitate the removal of the strap. Next provided is a long strap. The long strap has a width of about 1 inch. The long strap has a variable length of about between about 44 inches when contracted and about 82 inches when expanded. The long strap has a first end and a second end constituting handles. The long strap also has an intermediate extent stitched to the exterior surface of the short strap. The first end and second end of the long strap are formed with loops. Finally, two small buckles are provided. Each small buckle has parallel end plates. Each end plate has parallel first and second end cross pieces. A central cross piece is provided between the end plates. The central cross piece is parallel with and intermediate of the end cross pieces. The central cross piece of each small buckle receives a loop at the end of the long strap. A portion of the long strap winds through the spaces between the end cross pieces and the central cross piece for contracting and expanding purposes.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved solo-stretch exercise system which has all of the advantages of the prior art exercising devices of known designs and configurations and none of the disadvantages.

It is another object of the present invention to provide a new and improved solo-stretch exercise system which may be easily and efficiently manufactured and marketed.

It is further object of the present invention to provide a new and improved solo-stretch exercise system which is of durable and reliable constructions.

An even further object of the present invention is to provide a new and improved solo-stretch exercise system which is susceptible of a low cost of manufacture with regard to both materials and labor, and which accordingly is then susceptible of low prices of sale to the consuming public, thereby making such solo-stretch exercise system economically available to the buying public.

Even still another object of the present invention is to provide a solo-stretch exercise system for therapeutic stretching the feet, ankles, legs, hips and back of a user.

Lastly, it is an object of the present invention to provide a new and improved exercising device. The device includes a short strap. The short strap has an interior surface and an exterior surface with a first end and a second end and an intermediate extent. A first pile-type fastener is provided on the interior surface and a second pile-type fastener is provided on the interior surface. A large buckle has a parallel end plate with parallel first and second end cross pieces and a central cross piece. The first end cross piece receives the first end. A long strap has a first end constituting a handle. An intermediate extent of the long strap is coupled to the exterior surface of the short strap.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figures 1, 2:
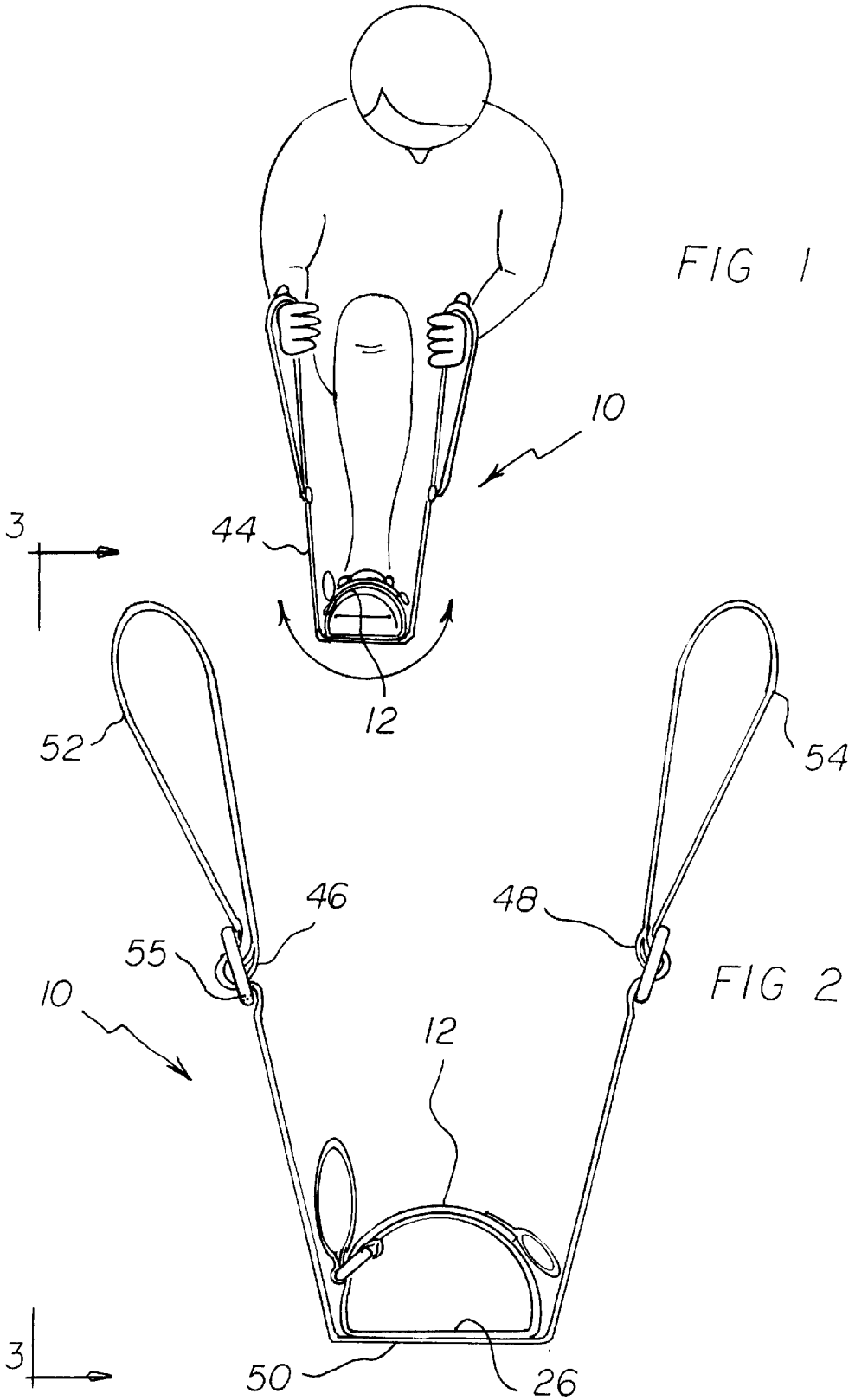
FIG. 1 is a front elevational view of the new and improved solo-stretch exercise system constructed in accordance with the principles of the present invention and illustrating the device being used through a releasable coupling on a shoe of a user's foot.
FIG. 2 is an enlarged front elevational view of the device shown in FIG. 1, the device adapted for providing various motions to the foot of a user including rotational forces.
Figure 3:
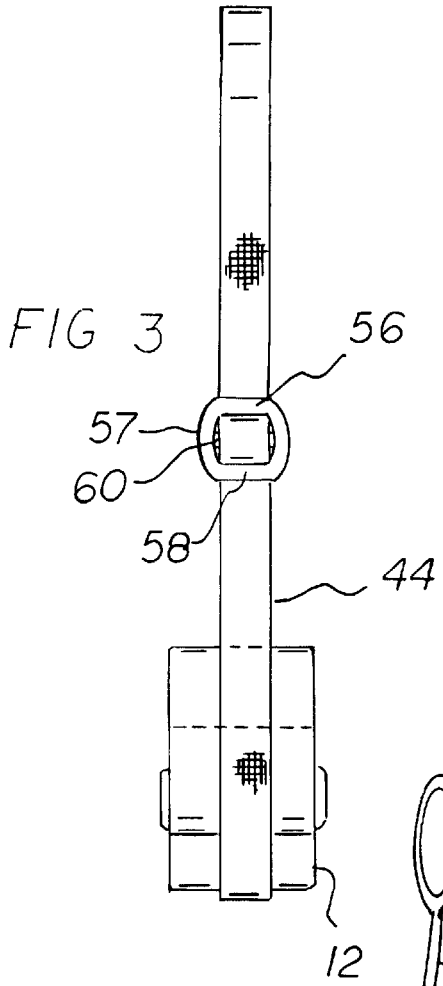
FIG. 3 is a side elevational view taken along line 3—3 of FIG. 2.

With reference now to the drawings, and in particular to FIG. 1 thereof, the preferred embodiment of the new and improved solo-stretch exercise system embodying the principles and concepts of the present invention and generally designated by the reference numeral 10 will be described.

The present invention, the solo-stretch exercise system 10 is comprised of a plurality of components. Such components in their broadest context include a short strap, a large buckle, and a long strap. Such components are individually configured and correlated with respect to each other so as to attain the desired objective.

First provided is a short strap 12. The short strap has an interior surface 14 and an exterior surface 16 with a width of about 2 inches and a length of about 20.5 inches. The short strap has a first end 18 with a stitched loop 20. The short strap also has a second end 22 with a stitched fold 24. The short strap also has an intermediate extent 26 between the ends. The short strap also has a first pile-type fastener 28 on the interior surface between the first end and the intermediate extent. In addition, the short strap has a second pile-type fastener 30 on the interior surface between the second end and the intermediate extent. The first and second pile-type fasteners are adapted to be releasably coupled together whereby the short strap may form a loop of a size determined by the user to receive a shoe on a user's foot.

Next provided is a large buckle 32. The large buckle has parallel end plates 34. The end plates have parallel first and second end cross pieces 36, 38. The end plates also have a central cross piece 40 between the end cross pieces. The central cross piece is parallel with and intermediate of the end cross pieces. The second end cross piece 38 receives the loop of the first end. The first end cross piece 36 is cooperable with the central cross piece for receiving the second end between the second end cross piece and the central cross piece.

A wide loop-shaped tab 41 is next provided. The loop-shaped tab is stitched to the second end cross piece. Also provided is a narrow loop-shaped tab 42. The narrow loop-shaped tab is stitched to the second end. The tabs are adapted to facilitate the positioning of the short strap around a shoe of a user's foot and to facilitate the removal of the strap.

Next provided is a long strap 44. The long strap has a width of about 1 inch. The long strap has a variable length of about between about 44 inches when contracted and about 82 inches when expanded. The long strap has a first end 46 and a second end 48 constituting handles. The long strap also has an intermediate extent 50 stitched to the exterior surface of the short strap. The first end and second end of the long strap are formed with loops 52, 54.

Finally, two small buckles are provided. Each small buckle has parallel end plates 57. Each end plate has parallel first and second end cross pieces 56, 58. A central cross piece 60 is provided between the end plates. The central cross piece is parallel with and intermediate of the end cross pieces. The central cross piece of each small buckle receives a loop at the end of the long strap. A portion of the long strap winds through the spaces between the end cross pieces and the central cross piece for contracting and expanding purposes.

Figure 4:
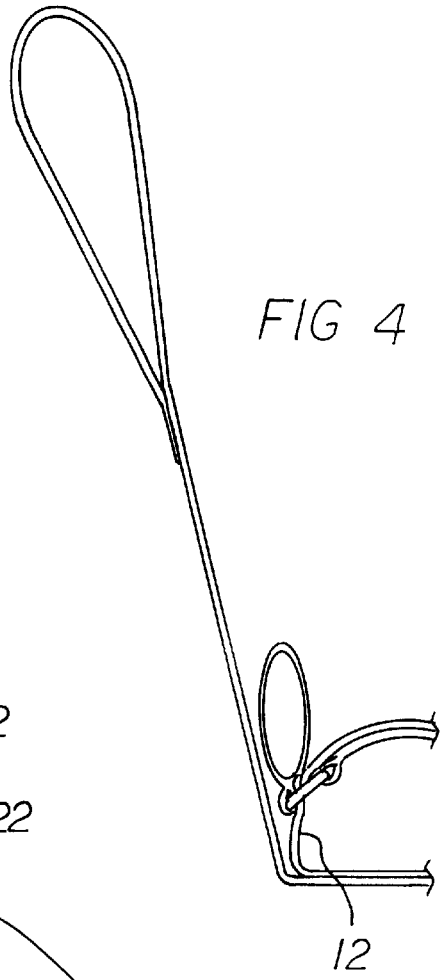
FIG. 4 is an enlarged front elevational view of a portion of the device shown in FIG. 2 but with the ends of the straps formed as a permanent loop rather than of an adjustably sized loop.
Figure 5:
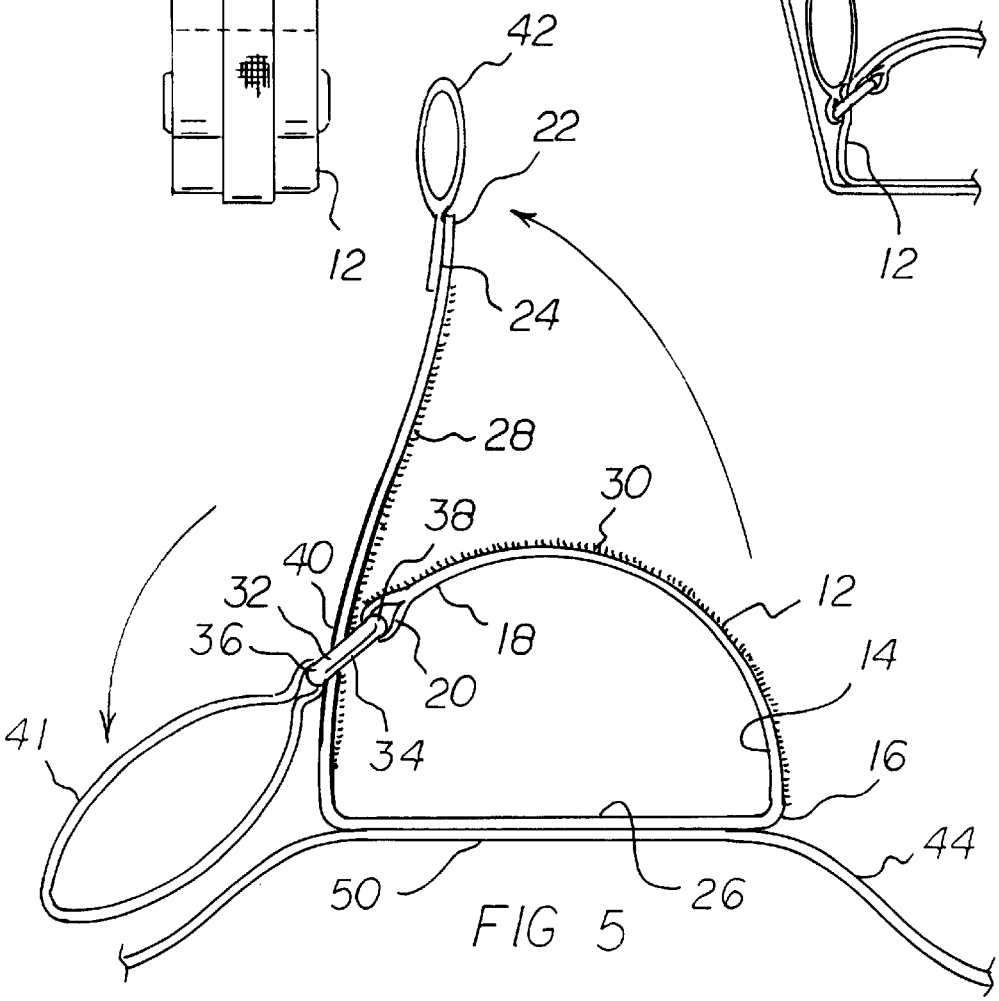
FIG. 5 is a front elevational view of the short strap but with the wide loop pulled down and the narrow loop pulled up to release the coupling between the pile-type fasteners for allowing the short loop to be put on or removed from a user's foot.

As can be seen in the embodiment of FIG. 4, the ends of the long straps are provided with a stitched permanent loop. In such embodiment, the small buckles are eliminated.

Figure 6:
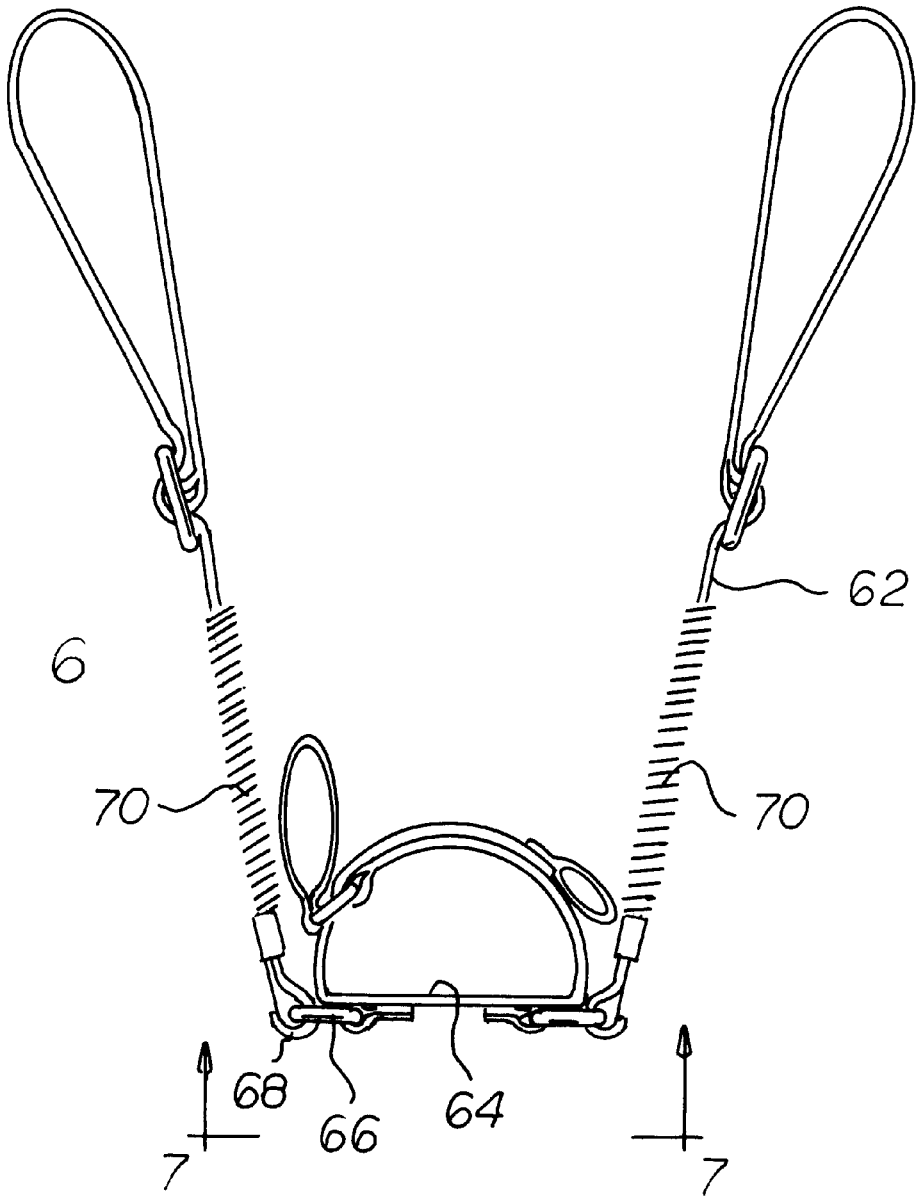
FIG. 6 is a front elevational view similar to FIG. 2 but illustrating an alternate embodiment with elastic members located along the length of the long straps and with the long straps releasably coupled to the short strap at its intermediate extent.
Figure 7:
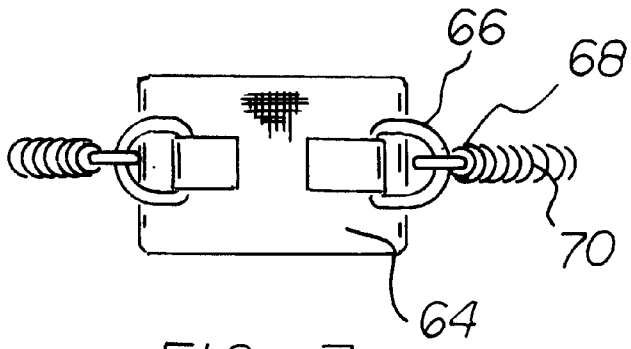
FIG. 7 is a bottom elevational view taken along line 7—7 of FIG. 6.

The alternate embodiment shown in FIG. 6 is similar to that of the primary embodiment. In such alternate embodiment, instead of a single long strap, there are utilized two separate long straps 62. Each interior end of the long straps are provided with clips 68 for coupling to the short strap 64 through a loop-like clip 66. In this embodiment, note is taken that a portion of each long strap is elastic 70. Such alternate construction has been found desirable for certain types of exercises.

Figure 8:
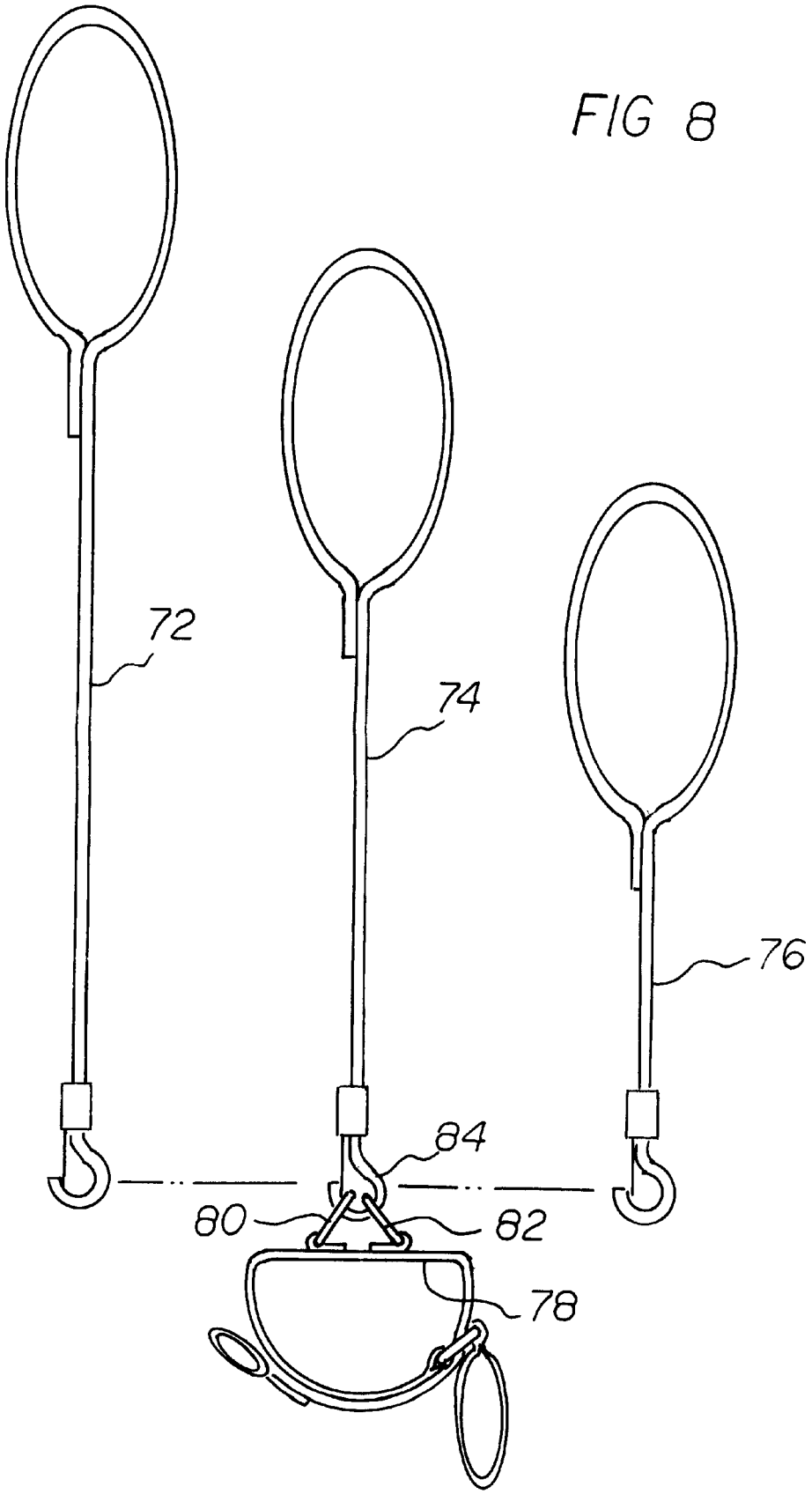
FIG. 8 is a further alternate embodiment of the invention wherein the long straps are of various lengths for use at the discretion of a user and wherein the clips at the ends of the long straps may be coupled together to both loops on the short loop or, in the alternative with two long straps coupled respectively to the two loops of the short loop.

In the final embodiment, that shown in FIG. 8, there are provided a plurality of long straps 72, 74, 76. Such long straps are adapted to be releasably coupled to the short strap 78. In such embodiment, releasably coupling between the long strap and short straps is achieved through clips 80, 82, 84.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved solo-stretch exercising system for therapeutically stretching the feet, ankles, and legs of a user comprising, in combination:

a short strap having an interior surface and an exterior surface with a width of about 2 inches and a length of about 20.5 inches, the short strap having a first end with a stitched loop and having a second end with a stitched fold and with an intermediate extent between the ends, a first pile-type fastener on the exterior surface between the first end and the intermediate extent and a second pile-type fastener on the interior surface between the second end and the intermediate extent, the first and second pile-type fasteners adapted to be releasably coupled together whereby the short strap may form a loop of a size determined by the user to receive a shoe on a user's foot;

a large buckle having parallel end plates with parallel first and second end cross pieces and a central cross piece between the end cross pieces and with the central cross piece parallel with and intermediate of the end cross pieces, the first end cross piece receiving the loop of the first end and the second end cross piece cooperable with the central cross piece for receiving there between the second end;

a wide loop-shaped tab stitched to the second end cross piece and a narrow loop-shaped tab stitched to the second end, the tabs adapted to facilitate the positioning of the short strap around a shoe of a user's foot and to facilitate its removal;

a long strap having a width of about 1 inch and a variable length of about between about 44 inches when contracted and about 82 inches when expanded, the long strap having a first end and a second end constituting handles with an intermediate extent stitched to the exterior surface of the short strap and with the first end and second end of the long strap being formed with loops; and two small buckles each having parallel end plates with parallel first and second end cross pieces and a central cross piece between the end plates and with the central cross piece parallel with and intermediate of the end cross pieces, the central cross piece of each small buckle receiving a loop at the end of the long strap and with a portion of the long strap winding through the spaces between the end cross pieces and the central cross piece for contracting and expanding purposes.

2. A new and improved solo-stretch exercising system for therapeutically stretching the feet ankles, and legs of a user comprising, in combination:

a short strap having an interior surface and an exterior, the short strap having a first end with a stitched loop and having a second end with a stitched fold and with an intermediate extent between the ends, a first pile-type fastener on the exterior surface between the first end and the intermediate extent and a second pile-type fastener on the interior surface between the second end and the intermediate extent, the first and second pile-type fasteners adapted to be releasably coupled together whereby the short strap may form a loop of a size determined by the user to receive a shoe on a user's foot, a large buckle having parallel end plates with parallel first and second end cross pieces and a central cross piece between the end cross pieces and with the central cross piece parallel with and intermediate of the end cross pieces, the first end cross piece receiving the loop of the first end and the second end cross piece cooperable with the central cross piece for receiving there between the second end;

a wide loop-shaped tab stitched to the second end cross piece and a narrow loop-shaped tab stitched to the second end, the tabs adapted to facilitate the positioning of the short strap around a shoe of a user's foot and to facilitate its removal;

a long strap having a variable length, the long strap having a first end and a second end constituting handles with an intermediate extent stitched to the exterior surface of the short strap and with the first end and second end of the long strap being formed with loops; and two small buckles each having parallel end plates with parallel first and second end cross pieces and a central cross piece between the end plates and with the central cross piece parallel with and intermediate of the end cross pieces, the central cross piece of each small buckle receiving a loop at the end of the long strap and with a portion of the long strap winding through the spaces between the end cross pieces and the central cross piece for contracting and expanding purposes.

* * * * *